United States Patent [19]

Kogut

[11] Patent Number: 4,982,448

[45] Date of Patent: Jan. 8, 1991

[54] SURGICAL GOWN WITH TRANSFER CARD

[75] Inventor: Walter Kogut, Asheville, N.C.

[73] Assignee: Work Wear Corporation, Inc., Asheville, N.C.

[21] Appl. No.: 334,686

[22] Filed: Apr. 6, 1989

[51] Int. Cl.[5] ..... A41D 13/12; A41D 13/00

[52] U.S. Cl. ..... 2/51; 2/114

[58] Field of Search ..... 2/51, 114

[56] References Cited

U.S. PATENT DOCUMENTS

| | | | |
|---|---|---|---|
| 4,019,207 | 4/1977 | Newman et al. | 2/51 |
| 4,255,818 | 3/1981 | Crowley et al. | 2/51 |
| 4,369,527 | 1/1983 | Paul | 2/51 |
| 4,371,986 | 2/1983 | Wichman | 2/51 |
| 4,373,214 | 2/1983 | Wichman | 2/51 |
| 4,384,370 | 5/1983 | Singer | 2/51 |
| 4,451,931 | 6/1984 | Wichman | 2/51 |
| 4,457,024 | 7/1984 | Wichman | 2/51 |
| 4,558,468 | 12/1985 | Landry et al. | 2/51 |

*Primary Examiner*—Werner H. Schroeder
*Assistant Examiner*—G. Hale
*Attorney, Agent, or Firm*—Pearne, Gordon, McCoy & Granger

[57] ABSTRACT

In a surgical gown belted by tie-strings, one of the tie-strings has one end secured to the gown and the other end releasably attached to a transfer card, and means is provided for adhesively but releasably securing the transfer card to the front of the gown.

6 Claims, 1 Drawing Sheet

SURGICAL GOWN WITH TRANSFER CARD

This invention relates to belted surgical gowns employing tie-strings to accomplish the belting and hold the gown around the wearer with a degree of tightness to suit the comfort of the wearer. The degree of tightness is generally determined by how tightly the tie-strings are tied. The tie-strings must remain sterile while they are tied.

More particularly the invention relates to belted gowns of the type wherein a transfer card is provided to maintain the sterile condition of a tie-string while the tie-string is passed around the back of a gown after the gown has been donned but before the tie-strings have been tied together. In this type of gown, the transfer card is releasably attached to the tie-string. The transfer card is pulled away from the tie-string and thrown away after the tie-string has been passed around the back of the wearer.

BACKGROUND OF THE INVENTION

Several different arrangements have been used or proposed for initially positioning the transfer card, and associated tie-string end, in relation to the front of the gown where they will be readily accessible to the person donning the gown to be handed off by that person to an assistant. The assistant can be a circulating nurse who need not be scrubbed in order to preserve sterility but who can grasp the card and use it to pass the tie-string around the back of the gown for hand-off of the tie-string itself to the person donning the gown. In Wichman U.S. Pat. No. 4,373,214, a transfer card is removably received in a pocket on the front of the gown. In Newman U.S. Pat. No. 4,019,207, a transfer card and associated tie-string are allowed to droop from a "tunnel loop" into which a portion of the tie string is temporarily tucked. In Allen et al. U.S. Pat. No. 3,935,596, a transfer card is releasably attached to the ends of both tie-strings. In Crowley et al. U.S. Pat. No. 4,255,818, a transfer card is also releasably attached to two strings, but only one of the two strings to which the card is attached is a tie-string. Crowley does provide a second tie-string for the gown, so that a total of three strings is used in this construction. In Landry et al. U.S. Pat. No. 4,558,468, again, a transfer card is attached to two strings and only one functions as a tie string, the other being a very short string or "tab". Landry provides a single long tie string intended to fully surround the gown when it is donned and tied, and a double-sided adhesive tape releasably holds the belt near a side margin of the gown.

While some of these constructions are believed to have enjoyed substantial commercial use, they are subject to various disadvantages. In the design where the transfer card is received in a pocket on the front of the gown, there are labor and material costs associated with providing the pocket on the front of the gown and positioning the card in the pocket.

In the design where the tie-string and associated card are allowed to droop from a "tunnel loop," the weight of the card may tend to prematurely pull the tie-string and card from the tunnel loop, thereby risking contamination by allowing the tie-string to drop below waist level. Accepted standards of operating room practice require replacement of a gown when this happens. Also, there are labor and material costs associated with providing the tunnel loop and tucking the tie-string which receives the card into the tunnel loop.

In the designs where the transfer card is releasably attached to the ends of both tie-strings or to one tie-string and another special string, the parts must be arranged in this condition during manufacture of the gowns, with associated costs and assembly problems. Furthermore, when the gown is donned, the card must be selectively removed from one or the other of the two strings while temporarily maintaining the connection with the other string. In other words, a sequential release of the card must occur, first from one string and then from the other. Unless special arrangements are made to assure that the release will be sequential, the operation of the design will be unreliable.

It is also known in the prior art to adhesively mount transfer devices adjacent a rear side margin of a surgical gown. In Collins U.S. Pat. No. 4,075,716, an adhesive tape or, alternatively, a "spot of adhesive" is used to releasably mount a "protective member" which functions similarly to a transfer card. However this "protective member" cannot be grasped and removed by the person donning the gown, and an unsterile assistant who does grasp it must be careful to do so in a way that avoids any contact with the gown or else sterility at that location on the gown is destroyed. Furthermore, release of the "protective member" from the gown undesireably exposes a sticky surface of the adhesive. Such exposure may, for example, result in the "protective member" sticking to the hand or sleeve of the assistant who grasps the "protective member."

BRIEF DESCRIPTION OF THE PRESENT INVENTION

The present invention provides a belted surgical gown in which the assembly of the transfer card in its initial position in association with the gown is accomplished by means such that the assembly operation is relatively simple and assembly costs are relatively low. The transfer card and its associated tie-string end are securely mounted in their initial releasable position so that accidental dislodging is prevented. Sequential removal of the card from one tie-string and then the other is not required.

According to the present invention, the transfer card is releasably adhered to the front of the gown by an adhesive, preferably a pressure sensitive adhesive, but in such a manner that no sticky surface is presented either on the face of the gown or on the card when the card is removed from its initial position to be utilized in passing the tie-string around the back of the gown.

The objects and advantages of the invention will be more fully understood from the following detailed description of an example thereof.

DETAILED DESCRIPTION OF THE DRAWINGS

DETAILED DESCRIPTION OF AN EXAMPLE OF THE INVENTION

Figure 1:
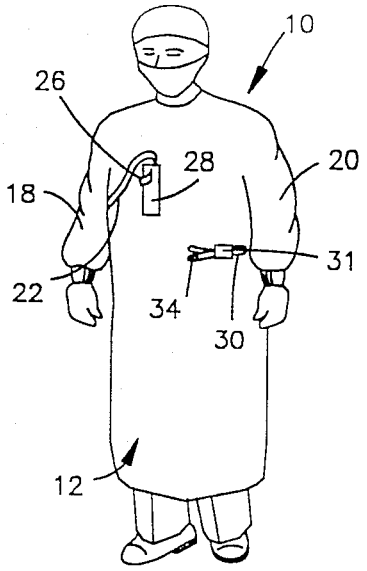
FIG. 1 is a sketch showing a person wearing a medical gown of the invention immediately after it has been donned and prior to tying of the belting for the gown.

In the illustrated example of the invention, a open-back gown generally indicated by the reference number 10 has side margins 14 and 16 (FIG. 3) which define the open back of the gown. The gown is provided with sleeves 18 and 20.

A first tie-string 22 has one end 24 (FIG. 2) secured to the gown. The other end 26 of this tie-string is releasably attached to a transfer card 28. The transfer card is adhesively but releasably mounted on the front of the gown by transfer card mounting means generally indicated by the reference number 32 (FIG. 5), to be described in more detail below.

A second tie-string 30 has one end 34 secured to the gown and is temporarily tucked into and supported by a loop 31 sewn or otherwise attached on the front of the gown.

The transfer card mounting means 32 defines a dry-peel interface 36 between the transfer card and the area of the gown on which the card is releasably secured. This interface may be formed for example between films 42 and 44 by hot lamination in the manner disclosed for example in U.S. Pat. No. 4,544,590 to Egan, or by coextrusion of the two films, or by any other suitable means, including an arrangement where one of the layers 42 or 44 is not a film but a paper and the other of the two layers is a film peelable therefrom to leave a "dry" interface in a known manner.

Figure 5:
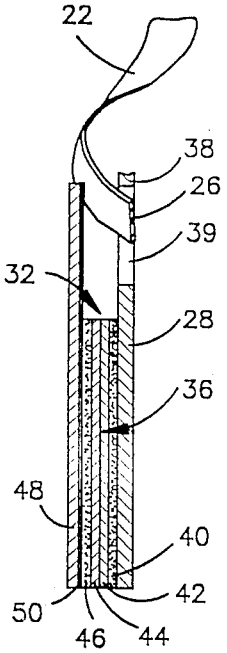
FIG. 5 is a cross-sectional view taken in side elevation along the longitudinal mid-plane of the transfer card as seen in FIG. 5, but with thicknesses of the elements greatly exaggerated, and with the transfer card in association with a release liner prior to the mounting of the transfer card on the front of the gown.

As shown in FIG. 5, prior to the mounting of the transfer card on the front of the gown, the films 42 and 44 on either side of the dry-peel interface 36 are joined respectively by an adhesive layer 40 to the transfer card proper 28, and by an adhesive layer 46 to the surface of a release liner 48 that carries a silicone release coating 50 or the like. Preferably, both layers 40 and 46 are pressure-sensitive adhesives, although they may also be other types of adhesives. For example, the layer 40 may be a heat activated adhesive.

The transfer card mounting means 32 terminates short of the free end 38 of transfer card 28. The slit 39 is formed in this free end and releasably receives the end 26 of the tie-string 22. The transfer card 28 comprises relatively stiff paper stock, and the sides of the slit 39 therefore firmly grip the sides of the tie-string 22 until such time as the tie-string 22 and transfer card 28 are firmly pulled apart.

The release liner 48 preferably extends beyond the transfer card mounting means 32 and to a point coextensive with the free end 38 of the transfer card 28, as shown in FIG. 5. This relationship tends to trap the tie-string 22 between the release liner and the free end 38 of the transfer card, thus contributing to the firmness and reliability of the temporary attachment between the tie-string and the transfer card prior to the time that the transfer card is mounted on the front of the gown.

Mounting of the transfer card on the front of the gown is accomplished during the manufacture of the gown by simply removing the release liner 48 and applying the remaining assembly against the front of the gown with the adhesive layer 44 against the gown, to thereby attach the transfer card to the gown, with the dry-peel interface between the gown and the transfer card proper. When this is done, the surface of the gown 10 (not seen in FIG. 5) cooperates with the free end 38 of the transfer card 28 to thereby tend to trap the tie-string therebetween, thereby in this respect performing the same function that the release liner did prior to the mounting of the transfer card.

The sides of the release liner 48 may extend beyond the sides of the transfer card 28, and may comprise part of a continuous strip on which a large number of transfer cards and associated transfer card mounting means are temporarily mounted, each extending transversely to the longitudinal direction of the continuous strip. The continuous strip may thereby function as a feeding device for picking off or dispensing individual cards. The cards may be attached to a succession of tie-strings associated with a succession of gowns, then stripped seriatim from the release liner 48 and immediately adhered to the fronts of the gowns by simply pressing the transfer cards, adhesive side down, against the fronts of the gowns.

In use, a gown made according to the invention is donned as shown in FIG. 1 after the wearer has scrubbed down. Interior ties (not shown) whose sterility is not required to be maintained, may be tied, and the neck may be secured by a hook and eye.

To accomplish the belting of the gown while maintaining sterility, the lower end of the transfer card 28 is then grasped by the wearer and peeled away from the front of the gown. The card mounting means 32 separates at the dry-peel interface so that no sticky adhesive is exposed either on the card or on the front of the gown. If desired, the bottom end of the card 38 may be extended slightly below the lower edge of the card mounting means 32 to provide a lifting tab (not shown) for more convenient peeling from the bottom end. Or, the top free end 38 can be used for this purpose.

Figure 2:
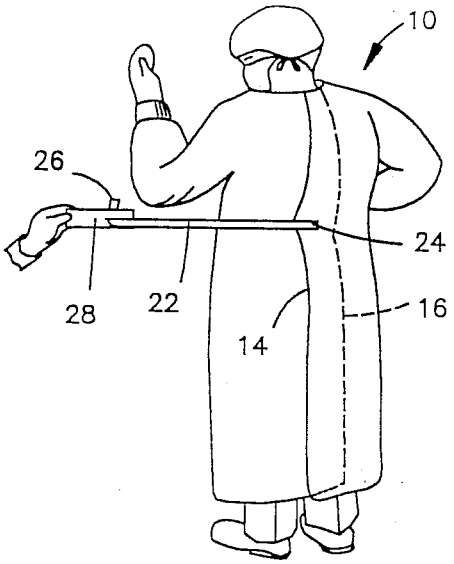
FIG. 2 is a sketch showing one tie-string of the belting being passed around the back of the person wearing the gown.
Figure 3:
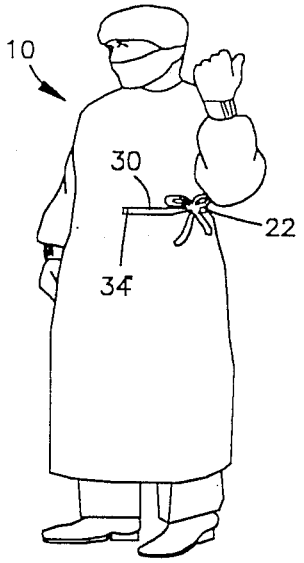
FIG. 3 is a sketch showing the person wearing the gown after the belting has been tied.
Figure 4:
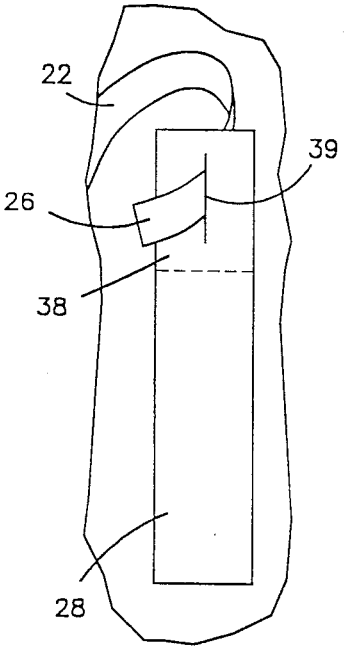
FIG. 4 is a fragmentary view on a greatly enlarged scale of a small part of FIG. 1, illustrating more clearly the transfer card shown in FIG. 1.

After the card is removed from the front of the gown by the wearer, it is passed to an assistant, such as a circulating nurse who is not scrubbed, who carries it around the back of the gown, as seen in FIG. 2. The wearer then grasps the sterile tie-string 22 while the assistant pulls the transfer card off the string, whereupon the wearer ties the tie-string 22 to the second tie-string 30 as seen in FIG. 3.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A surgical gown comprising a gown proper having a pair of sleeves, a front, a pair of side margins defining an open back for the gown, a first tie-string having one end secured to the gown and the other end releasably attached to a transfer card, a second tie-string having one end secured to the gown, and transfer card mounting means for adhesively but releasably securing said transfer card directly to the front of said gown, said transfer card mounting means including means defining a dry-peel interface between the transfer card and the area of the gown on which the card is releasably secured.

2. The gown of the preceding claim wherein an end of the transfer card extends to a free end beyond the area of said dry-peel interface, and said first tie-string is releasably attached to said transfer card at said free end.

3. In a process for volume manufacture of surgical gowns having tie-strings and also having transfer cards for passing strings around the backs of wearers who don the gowns, the steps comprising providing transfer cards backed with adhesive and carried on their adhesive sides on a liner, removing the cards from the liner and removably attaching each of them to an end of one of the tie-strings secured to an associated gown, and applying the adhesive-backed side of the card to the gown to adhesively but releasably secure the card and associated tie-string end in an initial position on the gown.

4. A process as in the preceding claim in which in said step of removing the cards from the liner, the cards are removed seriatim from the liner by pick-off or by dispensing means, are attached seriatim to tie-strings associated with a succession of gowns, and are applied adhesive side down to the gowns.

5. In a process for volume manufacture of surgical gowns having tie-strings and also having transfer cards for passing strings around the backs of wearers who don the gowns, the steps comprising providing transfer cards backed with pressure-sensitive adhesive and carried on their adhesive sides on a release liner, removing the cards from the liner and removably attaching each of them to an end of one of the tie-strings secured to an associated gown, and applying the adhesive-backed side of the card to the gown to adhesively but releasably secure the card and associated tie-string end in an initial position on the gown.

6. A process as in the preceding claim in which in said step of removing the cards from the liner, the cards are removed seriatim from the liner by pick-off or by dispensing means, are attached seriatim to tie-strings associated with a succession of gowns, and applied adhesive side down to the gowns.

* * * * *